US005582258A

United States Patent [19]

Tibbitts et al.

[11] Patent Number: 5,582,258

[45] Date of Patent: Dec. 10, 1996

[54] EARTH BORING DRILL BIT WITH CHIP BREAKER

[75] Inventors: Gordon A. Tibbitts, Salt Lake City; Wayne R. Hansen, Centerville, both of Utah

[73] Assignee: Baker Hughes Inc., Houston, Tex.

[21] Appl. No.: 397,657

[22] Filed: Feb. 28, 1995

[51] Int. Cl.[6] ..... E21B 10/46; E21B 10/60

[52] U.S. Cl. ..... 175/57; 175/429; 175/431

[58] Field of Search ..... 175/431, 429, 175/430, 428, 426, 397, 394, 393, 65, 57

[56] References Cited

U.S. PATENT DOCUMENTS

| | | | |
|---|---|---|---|
| 4,558,753 | 12/1985 | Barr | 175/431 |
| 4,574,895 | 3/1986 | Dolezal et al. | 175/429 |
| 4,913,244 | 4/1990 | Trujillo | 175/65 |
| 5,115,873 | 5/1992 | Pastusek | 175/429 X |
| 5,449,048 | 9/1995 | Thigpen et al. | 175/430 |

FOREIGN PATENT DOCUMENTS

WO94/15058 7/1994 WIPO .

*Primary Examiner*—Stephen J. Novosad

*Attorney, Agent, or Firm*—Marger, Johnson, McCollom & Stolowitz, P.C.

[57] ABSTRACT

A drill bit for boring an earth formation is designed for rotation in a given direction. The bit body includes an operating face with at least one cutting element formed thereon. A cutting surface formed on the cutting element faces in a forward direction with respect to the direction of rotation. A cutting edge is formed on the cutting surface and is embedded in the earth formation during boring so that the formation is received against a portion of the cutting surface. The cutting element creates successive formation chips during boring which grow in length during bit rotation. A chip breaker formed adjacent the cutting surface imparts a strain to the chip by bending and/or twisting the chip and thereby increases the likelihood that it will break off. In one aspect, fluid flows in a fluid course formed in front of the cutting element during boring. Twisting increases the surface area of the chip presented to fluid in the fluid course which further increases the likelihood that the chip will break.

18 Claims, 8 Drawing Sheets

EARTH BORING DRILL BIT WITH CHIP BREAKER

BACKGROUND OF THE INVENTION

1. Field of the Invention

The present invention relates generally to drill bits for boring an earth formation and more particularly to such bits which include structures for breaking formation chips during drilling.

2. Description of the Related Art

Drilling in shale or plastic formations, or in hard formations which act in a plastic manner, with a drill bit has always been difficult. The shale, under pressure and in contact with hydraulics, tends to act like a sticky mass, sometimes referred to as gumbo, which balls and clogs the bit. Once the bit balls up, it ceases to cut effectively.

One type of bit includes polycrystalline diamond compact (PDC) cutters which present a generally planar cutting face having a generally circular perimeter. A cutting edge is formed on one side of the cutting face which, during boring, is at least partially embedded into the formation so that the formation is received against at least a portion of the cutting surface. As the bit rotates, the cutting face moves against the formation and a chip, which rides up the surface of the face, forms. When the bit is functioning properly, the chip breaks off from the remainder of the formation. Drilling fluid, which is typically pumped down a drill string to which the bit is attached, flows through openings formed in the bit and into courses which are typically formed on the operating face of the bit adjacent the cutters. Fluid flowing through the courses breaks off chips formed by the cutters and transports the cuttings upwardly out of the bore hole. Additional chips are continuously formed, each one sliding up the face of the cutting surface and breaking off in a similar fashion. Such action occurring at each cutting element on the bit causes the bore to become progressively deeper.

As mentioned above, in some formations the chip formed at the cutter is not easily broken from the formation. In prior art bits, the chip, which is of substantially planar configuration, is typically parallel to the face of the cutter. The fluid course typically comprises a shallow trough which directs fluid across the face of the bit also parallel to the cutting face of each cutter. A relatively small surface area of each chip, namely the edge, is therefore presented to the fluid flow in the course. It would be desirable to present a larger surface area of the chip to the fluid flow thereby increasing the total force exerted by the fluid against each chip and increasing the likelihood that the chip will break off from the formation. It would also be desirable to impart strain to the chip in order to increase the likelihood that it will break from the formation.

SUMMARY OF THE INVENTION

A drill bit for boring an earth formation is designed for rotation in a given direction. The drill bit includes a bit body having an operating face with at least one cutting element formed thereon. A cutting surface formed on the cutting element faces in a forward direction with respect to the direction of rotation. A cutting edge formed on the cutting surface is embedded in the earth formation during boring so that the formation is received against a portion of the cutting surface. The cutting element creates successive formation chips which grow in length during bit rotation. In one aspect of the invention, the drill bit includes means for deflecting each of the chips away from the bit body during bit rotation. In another aspect, the drill bit includes means for twisting each of said chips.

The present invention overcomes the above enumerated disadvantages associated with prior drill bits. More specifically, the present invention prevents bailing or clogging of the drill bit by providing structure which acts on the chip to strain the chip and to deflect the chip away from the bit body, to twist the chip, or to present the face of the chip to fluid flow.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENTS

Figure 1:
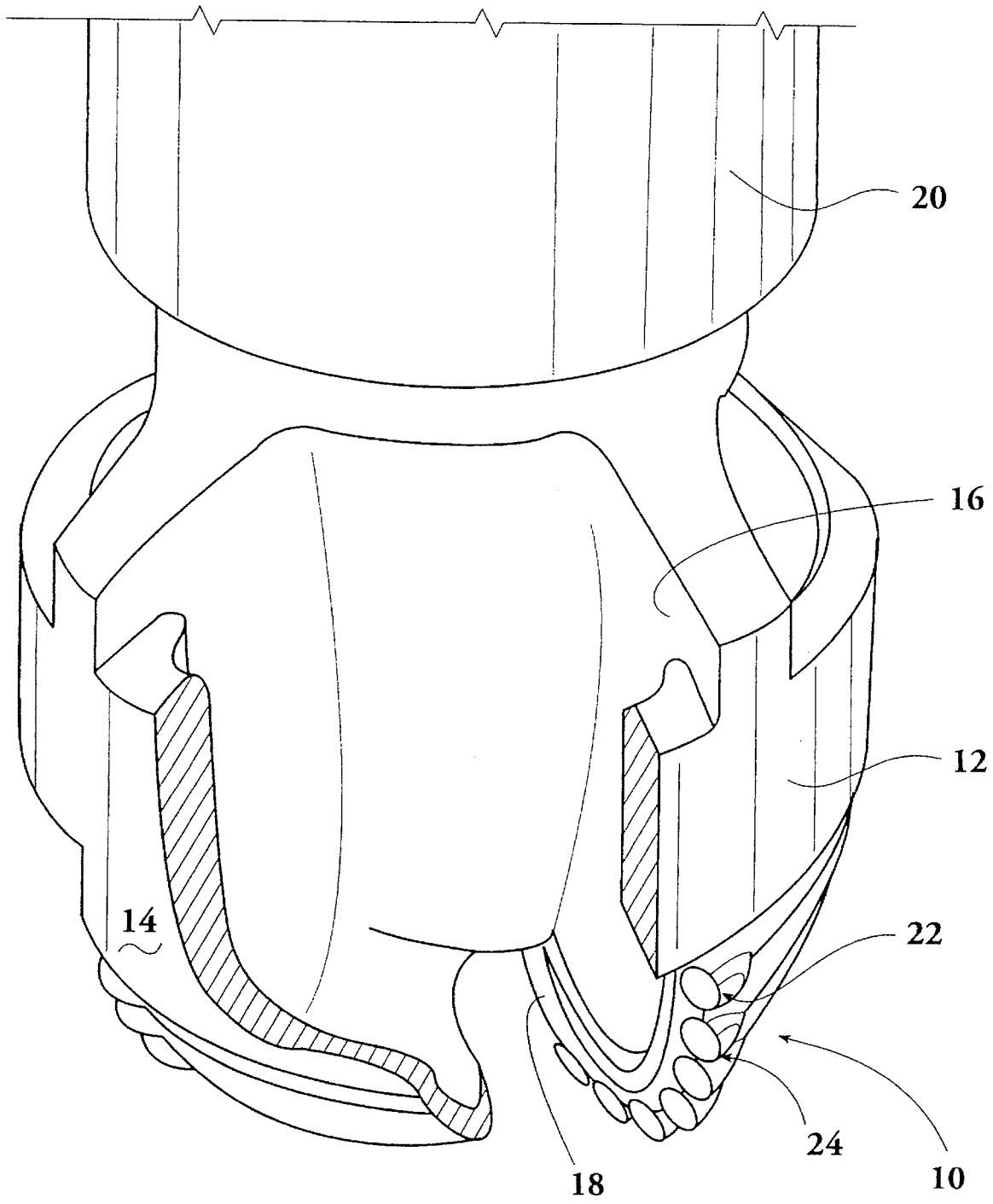
FIG. 1 is a perspective view of one of many possible drill bits constructed in accordance with the present invention shown partially broken away.

Indicated generally at 10 in FIG. 1 is a drill bit constructed in accordance with the present invention. Drill bit 10 is of the type disclosed in U.S. Pat. No. 5,199,511 for DRILL BIT AND METHOD FOR REDUCING FORMATION FLUID INVASION AND FOR IMPROVED DRILLING IN PLASTIC FORMATIONS which is incorporated herein by reference. Generally speaking, drill bit 10 includes a bit body 12 having an operating face 14. Bit body 12 includes an interior plenum or cavity 16 having a plurality of slots, one of which is slot 18, in FIG. 2. In FIG. 1, the bit body defining the left side of slot 18 is broken away to reveal interior bit structure.

Generally speaking, in operation bit 10 is connected to a drill string (not shown) via a threaded portion (not visible) formed on the upper part of a shank 20. Drilling fluid is pumped down the drill string and out one or more ports (not visible) on operating face 14. The fluid passes along and through the slots, like slot 18, (depicted by the upwardly directed arrow in FIG. 2) and from there to the surface of the bore via the annulus carrying formation chips cut by the bit.

Figure 2:
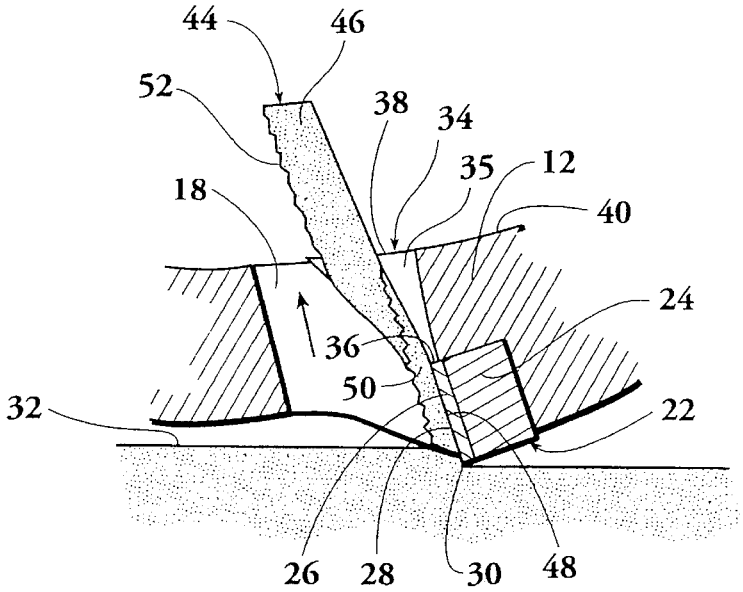
FIG. 2 is an enlarged sectional view of one of the cutters on the drill bit of FIG. 1.

Bit 10 includes a plurality of cutting elements like cutting elements 22, 24. As can be seen in FIG. 2, cutting element 22 includes a commercially available polycrystalline diamond compact (PDC) cutter 26 mounted on a cutter body 24 in a known manner to form cutting element 22. The cutting element is in turn mounted on bit body 12 using known technology.

Cutting element 22 presents a cutting surface 28 toward the direction of bit rotation which, in the view of FIG. 2, is from right to left or, considered from the view of FIG. 1, is clockwise when looking down the bore hole in which bit 10 is received.

A cutting edge 30 is embedded into a formation 32 in which bit 10 is drilling. The combined weight of bit 10 and the drill string from which it is suspended causes the cutting edges on each of the cutting elements, like cutting edge 30 on cutting element 22, to be embedded in formation 32 as depicted in FIG. 2.

A twisted ramp 34 is formed in body 12 adjacent cutting element 22 on the side of the cutting element opposite cutting edge 30. The following description is for twisted ramp 34; it will be appreciated, however, that each of the other cutting elements on drill bit 10 may also have a twisted ramp adjacent thereto although these features are not discernable in the view of FIG. 1.

Twisted ramp 34 is includes a ramp surface 35. Preferably ramp surface 35 comprises a polished or otherwise smooth surface such as a diamond or other coating which can be made by a person having ordinary skill in the all. One side of surface 35 is bounded by a first circular edge 36 adjacent the circular edge of the cutting surface 28 generally opposite cutting edge 30. A second generally opposite edge 38 of surface 35 is defined along an inner surface 40 of bit body 12. A third edge 42 defines one lateral edge of surface 35 with the other generally opposite lateral edge being in that portion of the bit which is sectioned away by the view of FIG. 2. As used herein the term "twisted ramp" refers to a surface which is not in the plane of the cutting surface, like cutting surface 28, of an associated cutting element.

As the bit rotates, with the direction of bit movement in FIG. 2 being from right to left, the lower portion of cutting surface 28 moves against the formation and a chip 44, which rides up the surface of the face as shown, forms. The chip includes a first surface 46 and a second surface 48 which, on the lower portion of chip 44, is flushly against cutting surface 28 of cutter 26. An edge 50 of formation chip 44 is also visible in FIG. 2. An opposing edge 52 defines the side of chip 44 opposite edge 50.

As chip 44 forms and moves up the face of cutting surface 28, it slides onto twisted ramp 34. The smooth or polished surface 35 facilitates chip sliding. Known hydraulic and mechanical forces, especially in shale or plastic formations, maintain surface 48 of the chip flushly against cutting surface 28 and surface 35 of twisted ramp 34 as shown. The angle on the ramp causes the chip to twist as shown in FIG. 2. Twisting of chip 44 imparts internal strains therein which make it weaker and therefore more likely to break off responsive to fluid circulating upwardly in slot 18.

Figure 3:
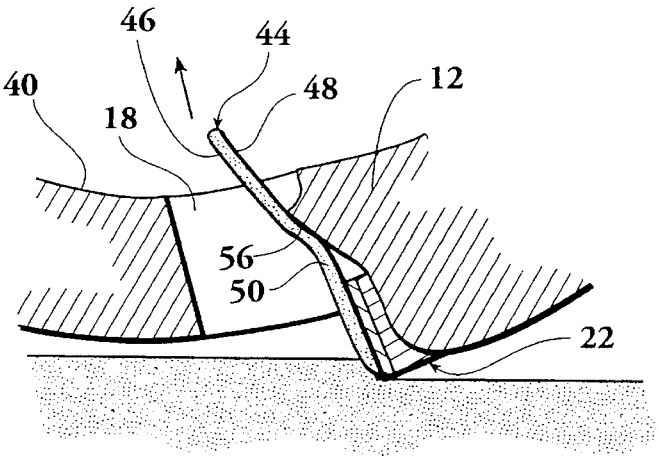
FIG. 3 is an alternative embodiment of the invention depicted in a view similar to FIG. 2.

Turning now to FIG. 3, a slightly modified embodiment of the drill bit from that depicted in FIG. 2 is illustrated. The same numerals appearing in FIG. 3 which are previously used in FIG. 2 correspond to generally the same structure depicted in FIG. 3. In the bit of FIG. 3, a non-twisted ramp 56 deflects chip 44 as it rides up the cutting face of cutting element 22 in slot 18. As can be seen, as chip 44 strikes ramp 56 it bends out, to the left in the view of FIG. 3, into a central portion of slot 18 where the fluid flows upwardly as described. This exposes more of surface 46 to the fluid flow thereby increasing the force which the fluid applies against chip 44 and increasing the likelihood that the chip will break off before balling and clogging of the bit occurs. The bending also strains the chip thereby increasing the likelihood that it will break.

Figure 4:
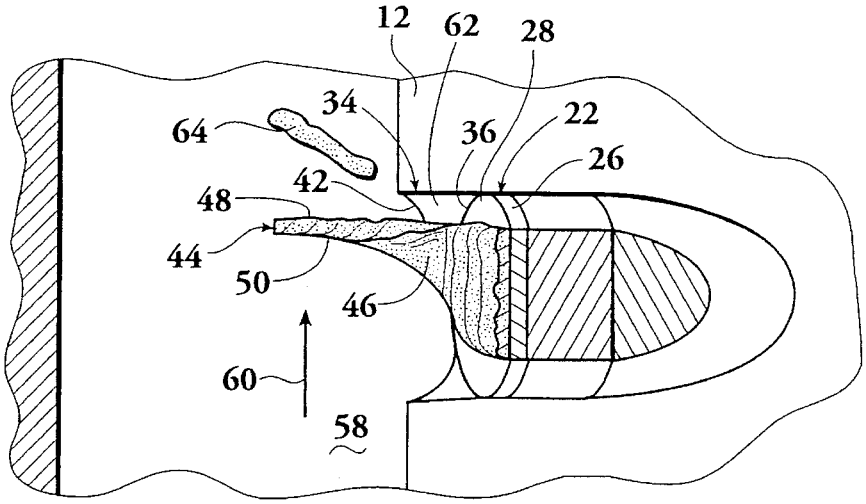
FIG. 4 is a sectional view of an alternative embodiment of the invention depicted during drilling.

Turning now to FIG. 4, the same numerals used in FIGS. 2 and 3 identify generally corresponding structure in the embodiment of FIG. 4. The drill bit depicted in FIG. 4 is incorporated into a bit having fluid courses, like fluid course 58, formed on the surface thereof for directing fluid along the surface of the bit. In the bits of FIGS. 1–3, however, fluid flows from the outside to the interior of the bit via slots, like slot 18. When the bit of FIG. 4 is operating, fluid in the fluid course flows generally in the direction indicated by arrow 60. Ramp 34 includes a surface 62 which defines generally a portion of a cylinder between circular edge 36 and edge 42. Surface 62 is curved substantially the same as edge 36. Because edge 42 is closer to surface 28 at the central portion of cutter 26 than at its lateral sides, as chip 44 forms, surface 62 twists the end of the chip coming off surface 28 as shown in FIG. 4. Such twisting strains the chip thereby weakening it and increasing the likelihood that fluid flowing in fluid course 58 will break it off. In addition, the twisting action on chip 44 presents surface 46 toward fluid flowing in the course thereby presenting a larger surface area of the chip to the fluid flow and increasing the force of the fluid acting on the chip. A previously formed chip 64 is shown broken away under action of fluid in the fluid course.

Figure 5:
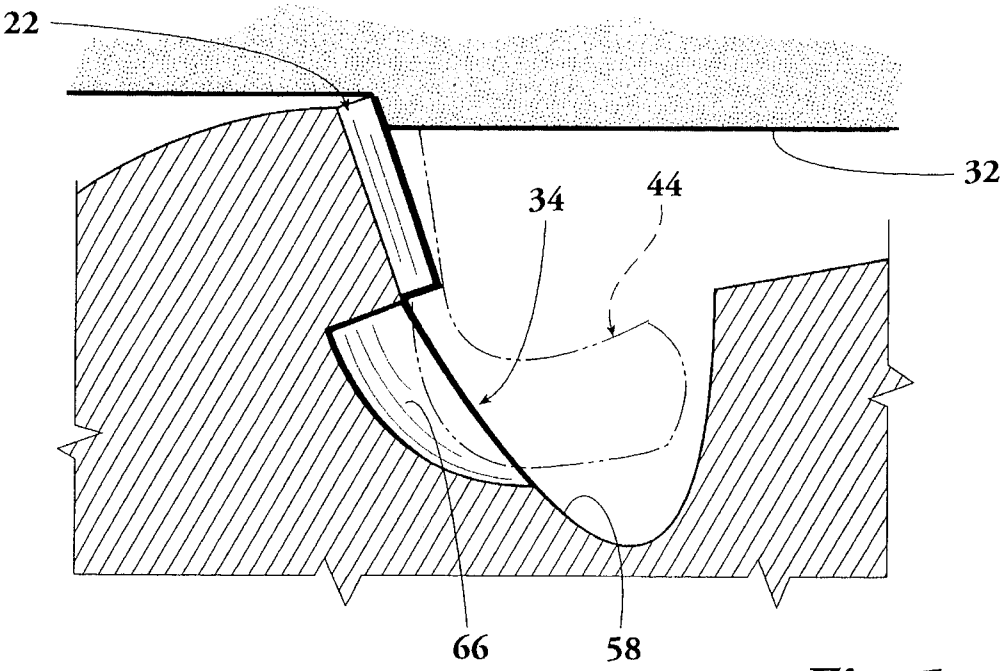
FIG. 5 is a partial sectional view of another drill bit incorporating the invention also depicted during drilling.

Turning now to FIG. 5, another embodiment of the present invention is illustrated therein. As can be seen, a ramp 34 is formed within fluid course 58 beneath cutter 22. The ramp includes a surface 66 which is curved, but not symmetrically with respect to cutter 22. As chip 44 extends down the face of cutter 22 and against surface 66, the curve on the surface twists the chip as shown thus moving it further into fluid course 58 while simultaneously twisting the chip to strain it and to present more surface area to fluid flowing in the course. The strain and increased force applied by the fluid break the chip so that it can be carried down the fluid course and circulated to the surface of the formation.

It should be appreciated that any or all of the various embodiments depicted in FIGS. 2–5 could be incorporated into the drill bit of FIG. 1. Moreover, conventional cutters not incorporating adjacent chip breaking structure could also be included.

Figure 8:
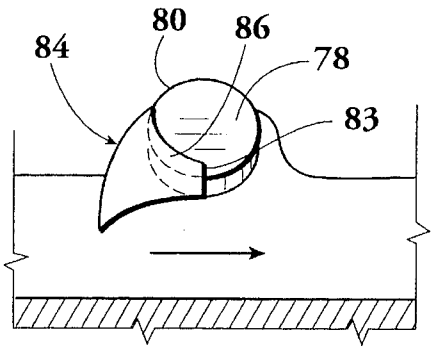
FIG. 8 is a view taken along line 8—8 in FIG. 7.
Figure 6:
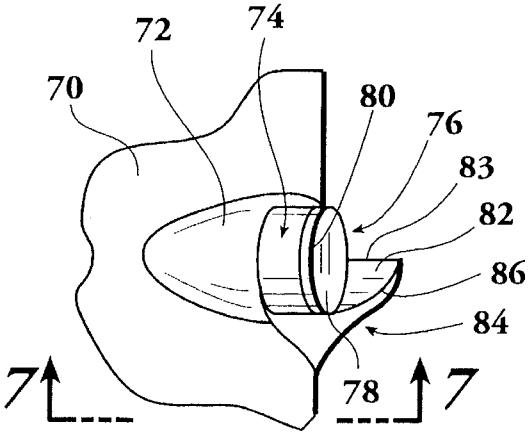
FIG. 6 is a view of a cutter on another drill bit incorporating another embodiment of the invention.
Figure 7:
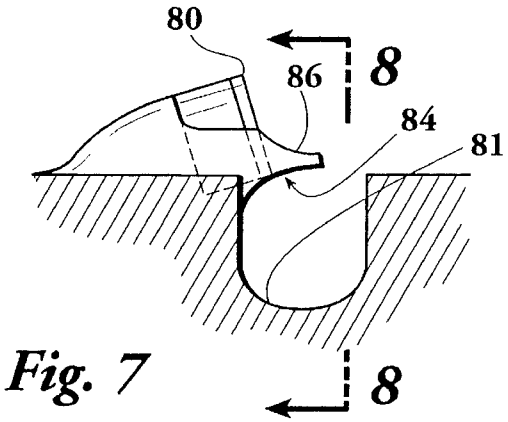
FIG. 7 is a view taken along line 7—7 in FIG. 6.

Turning now to FIGS. 6–8, another embodiment of the drill bit constructed in accordance with the present invention is depicted. The bit includes a body 70 having a pocket 72 formed thereon for receiving and holding a cutting element 74. The cutting element is mounted on pocket 72 in a known manner. Cutting element 72 includes a PCD compact cutter 76 having a cutting surface 78 and a cutting edge 80. A portion of a generally cylindrical surface 82 is formed adjacent a lower, as viewed in FIGS. 7 and 8, quadrant of cutter 76.

Surface 82 is formed on a lip 84 which is part of bit body 70. As with previous embodiments, surface 82 is preferably smooth or polished. The lip includes a front edge 86 which defines the leading edge of surface 82. A substantially straight side edge 83 extends outwardly beneath a central portion of cutter 76. Surface 82 has the same degree of curvature as cutter 76. A fluid course 81, in FIG. 7, is formed immediately beneath lip 84 as shown.

Figure 10:
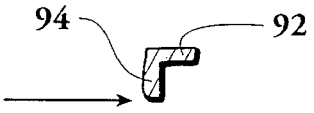
FIG. 10 is a view taken along line 10—10 of FIG. 9.
Figure 9:
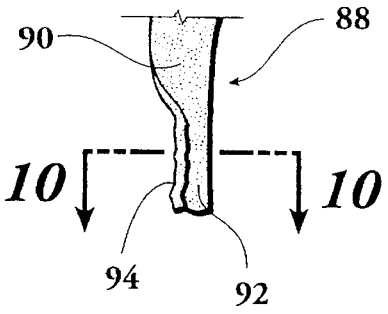
FIG. 9 is a view of a formation chip formed by the cutter of FIG. 8.

In operation, cutting edge 80 is embedded in the formation. As the drill bit rotates, a chip, like chip 88 in FIG. 9, rides down (in the view of FIG. 8) cutting surface 78. Chip 88 is depicted in FIG. 9 for the sake of clarity rather than in FIG. 8 which would obscure the structure in FIG. 8. Chip 88, however, can be envisioned in the position shown at FIG. 9 on cutting surface 78 in FIG. 8 with an upper portion 90 of the chip having a rear surface (not visible) flushly against cutting surface 78. Chip 88 includes a first lower portion 92 and a second lower portion 94 which are substantially at right angles with one another as shown in FIG. 10. This configuration results from lower portion 92 proceeding substantially downwardly off of cutting face 78 to the right of edge 83, as viewed in FIG. 8. Portion 94 on the other hand strikes surface 82, which is at an angle of substantially 90° to surface 78 and is bent thereby to the configuration shown in FIG. 10. It should be appreciated that the present invention can be implemented with surfaces having a wide range of inclinations and directions which impart strain to the chip as it strikes the surface. Such bending has the effect of exposing the left-side surface of lower portion 94, as viewed in FIG. 10, to fluid flowing in the fluid course which is in the direction of arrows depicted in FIGS. 8–11. Rather than exposing only an edge of chip 88 to the flow in fluid course 81, a portion of the surface area of one side of the chip is exposed. This both impass strain to the chip and increases the force of fluid in the course acting on the chip thereby increasing the likelihood that the chip will be broken away.

Figure 11:
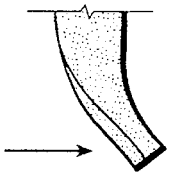
FIG. 11 is a view of the chip of FIG. 9 after being deformed by fluid flowing in the fluid course visible in FIG. 7.

FIG. 11 depicts the chip bending in response to fluid flowing in the fluid course.

Figure 12:
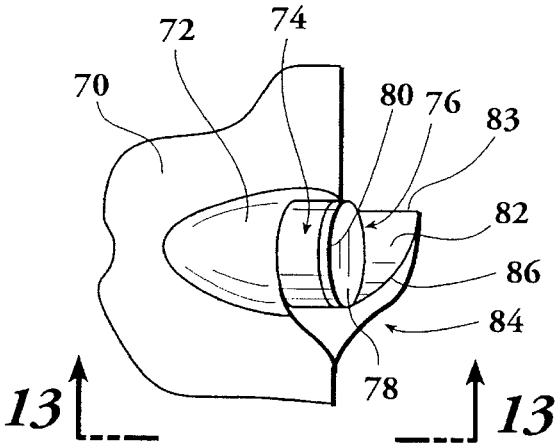
FIG. 12 is a view of a cutter on another drill bit incorporating another embodiment of the invention.
Figure 13:
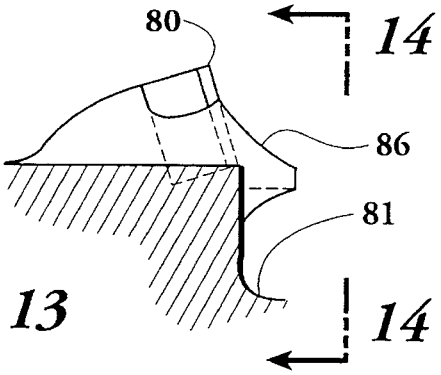
FIG. 13 is a view taken along line 13—13 in FIG. 12.
Figure 14:
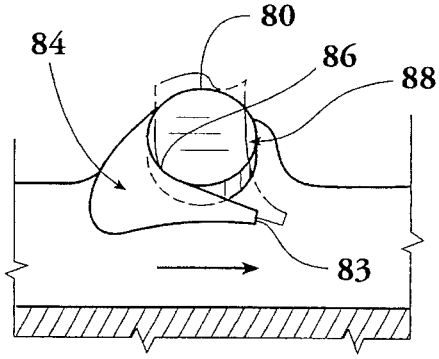
FIG. 14 is a view taken along line 14—14 in FIG. 13.

Turning now to FIGS. 12–14 depicted therein is another drill bit incorporating the present invention slightly modified from the one shown in FIGS. 6–8 and described above. Like numerals identify structure which corresponds generally to previously shown and described structure.

Figure 15:
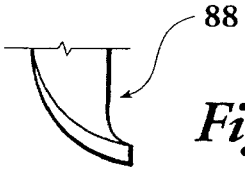
FIG. 15 is a view of a formation chip formed by the cutter of FIG. 14.

It will be readily apparent that lip 84, as well as surface 82 which is formed on the lip, extends substantially entirely beneath the lower portion of cutter 76 in FIG. 12 while in FIG. 6 the lip extends only approximately halfway across the underside of the cutter. It can thus be seen that substantially all of a chip formed by the cutters of the drill bit of FIGS. 12–14 strikes surface 82 with the result being that substantially all of the lower portion of the chip sliding downwardly, as viewed in FIGS. 13 or 14, on cutting surface 78, strikes surface 82. This has the effect of twisting substantially the entire chip, rather than only a portion thereof, substantially 90°. This is illustrated ill the view of FIG. 14 with chip 88 being depicted in dot-dash lines and shown ill solid form in FIG. 15. Such action strains the chip and presents substantially the entire surface of one side of the chip to fluid flowing in the fluid course thereby substantially increasing the force of the fluid exerted on the chip as compared to fluid being urged against only an edge of the chip. Although the embodiments described herein are shown with cylinder cutters, it should be appreciated that the present invention could be equally well incorporated in a drill bit having stud cutters.

Figure 16:
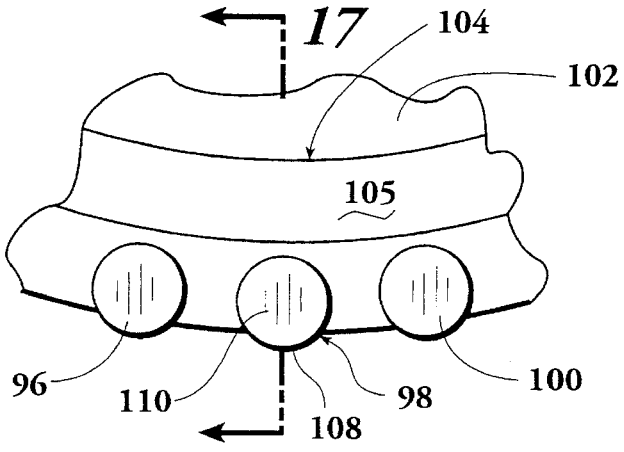
FIG. 16 is a partial view of several cutters on a drill bit incorporating another embodiment of the present invention.
Figure 17:
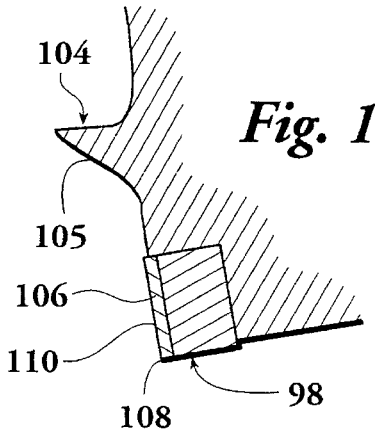
FIG. 17 is a view taken along line 17—17 of FIG. 16.

Turning now to FIGS. 16 and 17, depicted therein is another embodiment of the invention. Included therein are a plurality of cutting elements 96, 98, 100 mounted on a bit body 102 in a known manner. A chip breaker 104 is formed on the bit body as shown in FIG. 16 and 17. Chip breaker 104 includes an inclined surface 105. Cutting element 98 includes a cutter 106 having a cutting edge 108 formed on one side of a cutting surface 110.

In operation, when each of the cutting elements 96, 98, 100 are embedded in a formation in a bore hole and the bit rotates, a chip is formed which begins moving upwardly across surface 110. As the chip moves upwardly off of surface 110 on the cutter, it begins riding up surface 105 on the bit body which bends the chip and therefore breaks it as a result of the stresses induced therein responsive to bending.

Figure 20:
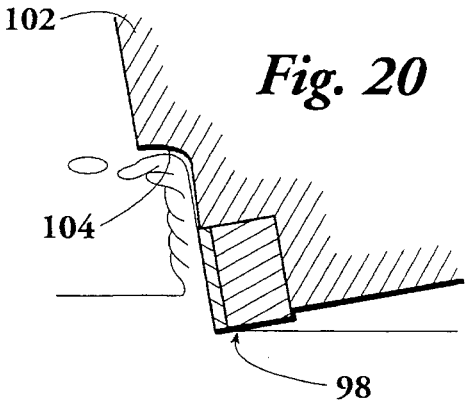
FIG. 20 is a partial sectional view, similar to FIG. 17, of a drill bit incorporating another embodiment of the present invention and showing a formation chip being cut from a formation.
Figure 21:
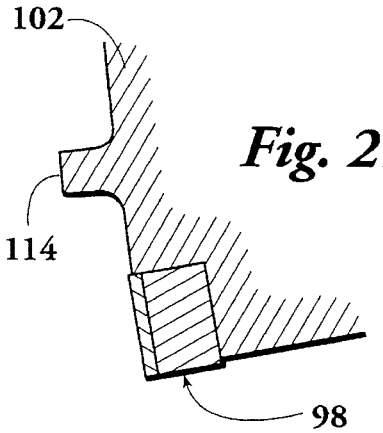
FIG. 21 is a partial sectional view, similar to FIG. 17, of a drill bit incorporating another embodiment of the present invention.
Figure 22:
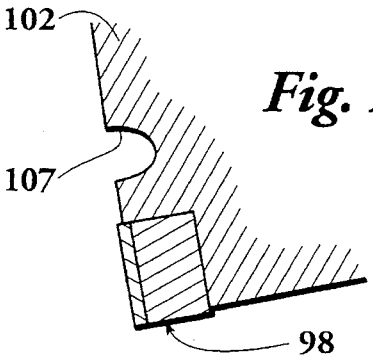
FIG. 22 is a partial sectional view, similar to FIG. 17, of a drill bit incorporating structure for relieving fluid pressure which tends to urge the chip against the cutter and bit body.
Figure 23:
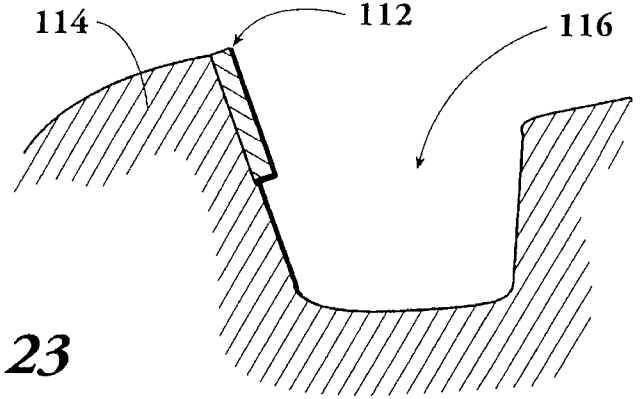
FIG. 23 is a partial sectional view of a cutter on a drill bit incorporating another embodiment of the present invention.
Figure 24:
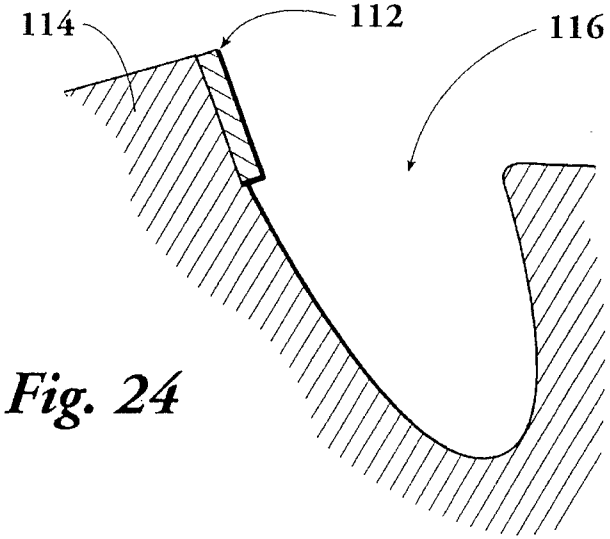
FIG. 24 is a partial sectional view of a cutter on a drill bit incorporating another embodiment of the present invention.
Figure 25:
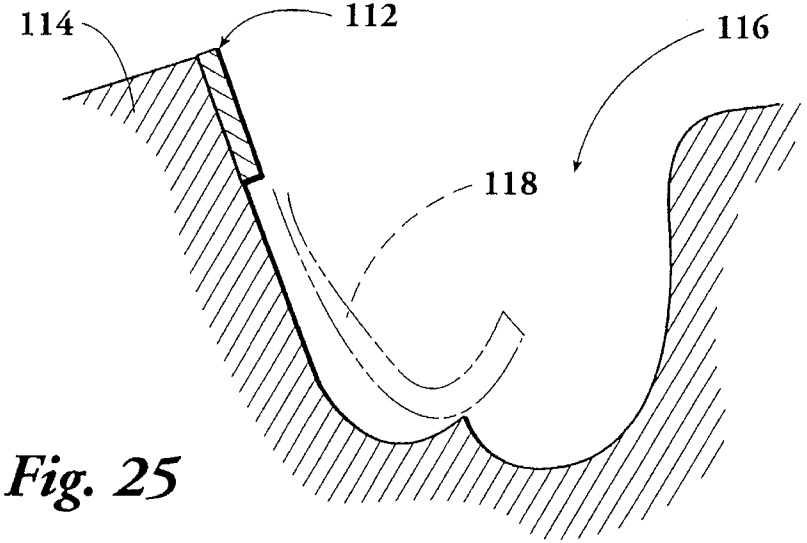
FIG. 25 is a partial sectional view of a cutter on a drill bit incorporating another embodiment of the present invention including a formation chip shown in dashed lines.
Figure 26:
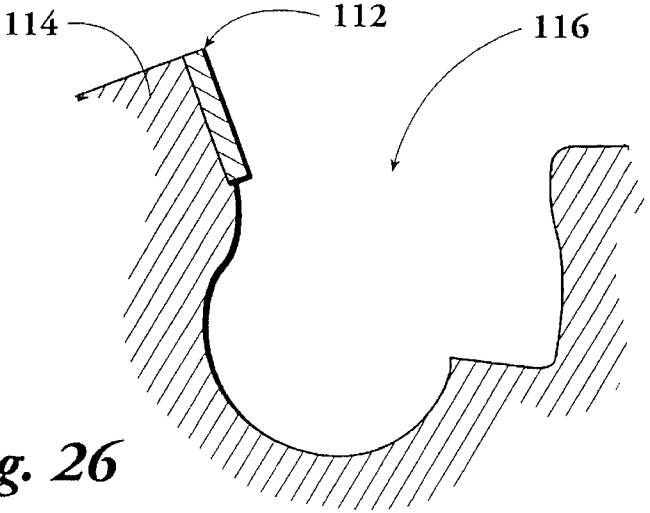
FIG. 26 is a partial sectional view of a cutter on a drill bit incorporating another embodiment of the present invention.
Figure 28:
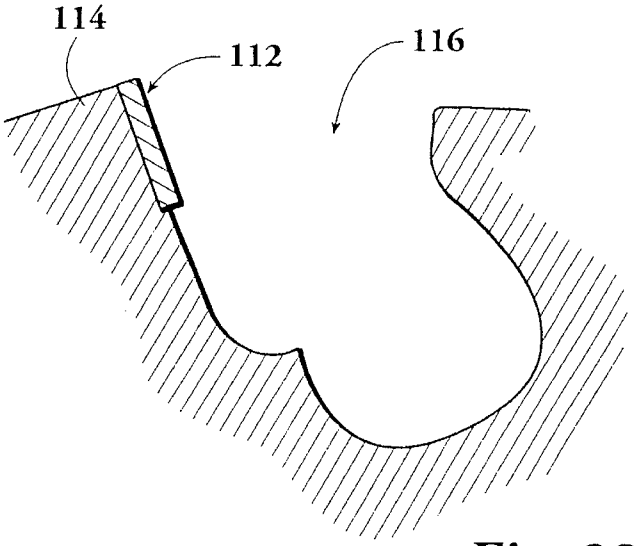
FIG. 28 is a partial sectional view of a cutter on a drill bit incorporating another embodiment of the present invention.
Figure 30:
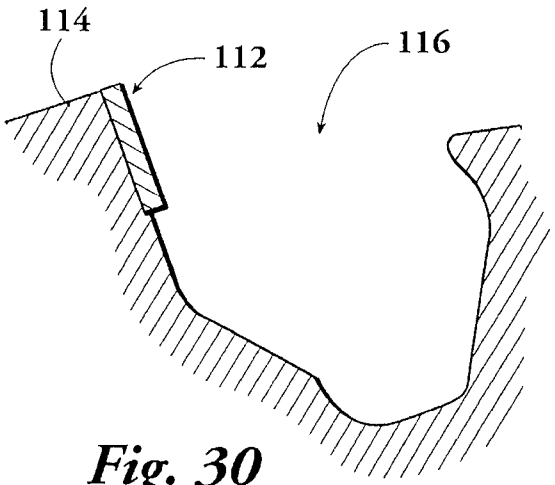
FIG. 30 is a partial sectional view of a cutter on a drill bit incorporating another embodiment of the present invention.

In FIGS. 20–22, structure corresponding generally to that identified in FIGS. 16–17 is identified with the corresponding numeral from FIGS. 16–17. FIGS. 20 and 21 depict continuous chip breakers 104 which function similarly to chip breaker 104 in FIGS. 16–17. In operation, when each of the cutting elements 96, 98, 100 are embedded in a formation in a bore hole and the bit rotates, a chip is formed which begins moving upwardly across the surface of each of cutters 96, 98, 100. As the chip moves upwardly off of each cutter surface, it encounters the chip breaker positioned above each cutter and breaks as a result of the stresses induced therein responsive to bending imparted by the chip breaker. Bending can occur as a result of the formation chip striking a chip breaker which extends from a blade of the drill bit, as is the case with the chip breaker of FIG. 21. It can also break as a result of encountering a wall built into the drill bit blade as is the case with the chip breaker of FIG. 20.

In FIG. 22, a groove 107 formed in the bit body above cutter 98 allows the hydraulic pressure in borehole to be communicated to a rear surface of a formation chip as it moves upwardly (in the view of FIG. 22) while being cut. This relieves the pressure differential across the chip and reduces the hydraulic force which tends to urge the chip against the cutter and bit body. Structure for relieving this pressure differential, such as groove 107, can be effectively used in connection with any of the various chip breakers disclosed herein to relieve the pressure differential across the chip to facilitate the bending and/or twisting action imparted by the chip breaker.

Figure 18:
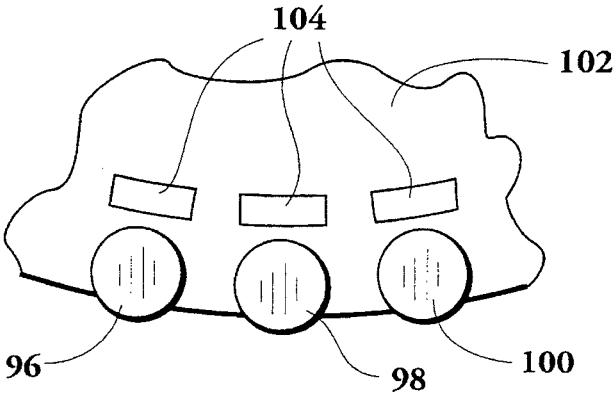
FIG. 18 is a partial view of several cutters on a drill bit incorporating another embodiment of the present invention.
Figure 19:
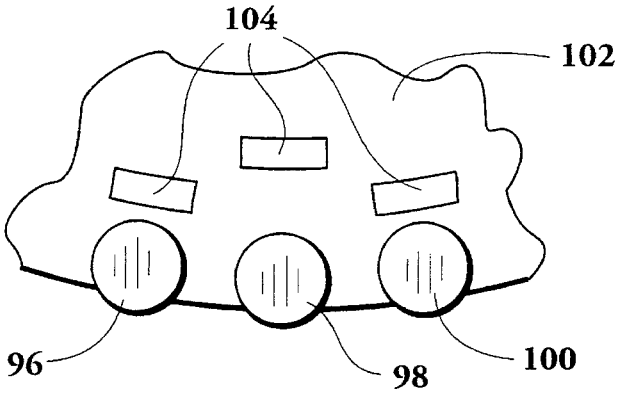
FIG. 19 is a partial view of several cutters on a drill bit incorporating another embodiment of the present invention.

FIGS. 18–19 illustrate two embodiments of the present invention which utilize discrete chip breakers. In these embodiments, the chip breaker can be of the type which extends from the drill bit body, like that in FIG. 21 or can be recessed, like that of FIG. 22. Similarly, discrete chip breakers like that shown in FIGS. 17 or 20 could also be utilized to bend each chip thereby creating stress in the chip which increases the likelihood that the chip will break from the formation.

Figure 35:
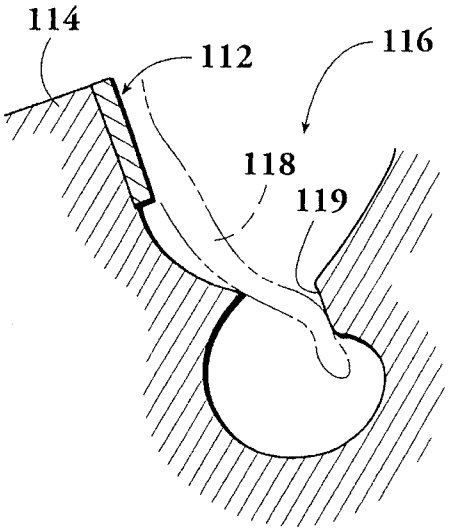
FIG. 35 is a partial sectional view of a cutter on a drill bit incorporating another embodiment of the present invention including a formation chip shown in dashed lines.
Figure 27:
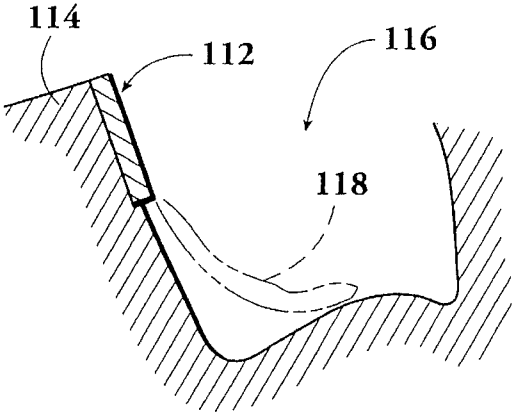
FIG. 27 is a partial sectional view of a cutter, on a drill bit incorporating another embodiment of the present invention including a formation chip shown in dashed lines.
Figure 29:
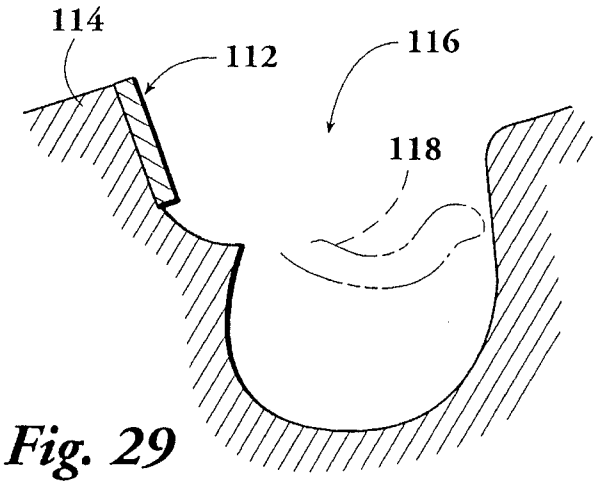
FIG. 29 is a partial sectional view of a cutter on a drill bit incorporating another embodiment of the present invention including a formation chip shown in dashed lines.
Figure 32:
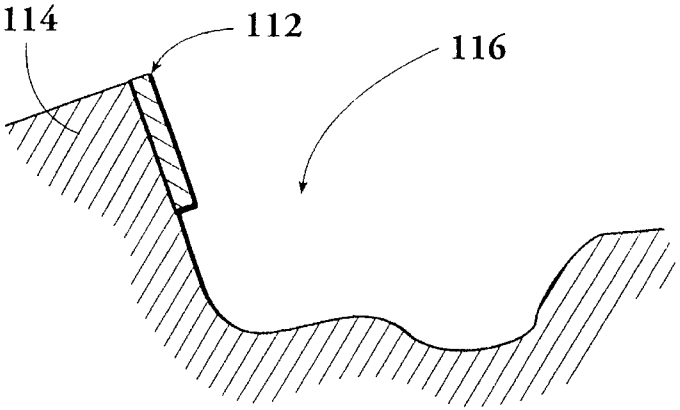
FIG. 32 is a partial sectional view of a cutter on a drill bit incorporating another embodiment of the present invention.
Figure 31:
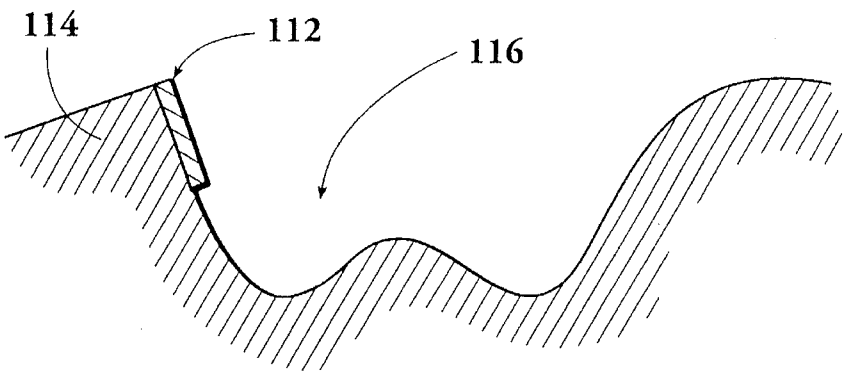
FIG. 31 is a partial sectional view of a cutter on a drill bit incorporating another embodiment of the present invention.
Figure 34:
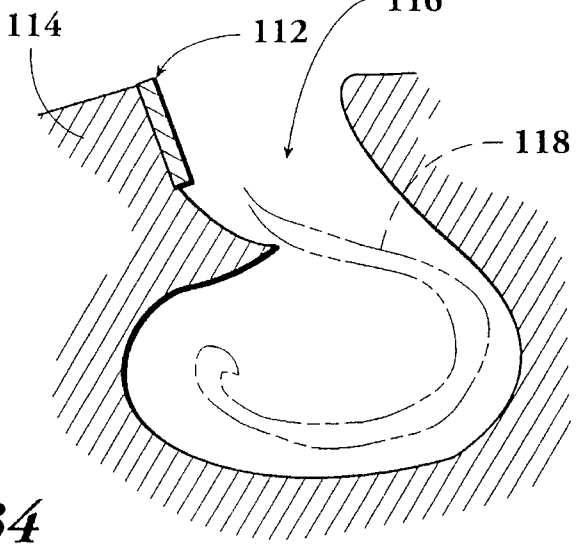
FIG. 34 is a partial sectional view of a cutter on a drill bit incorporating another embodiment of the present invention including a formation chip shown in dashed lines.
Figure 33:
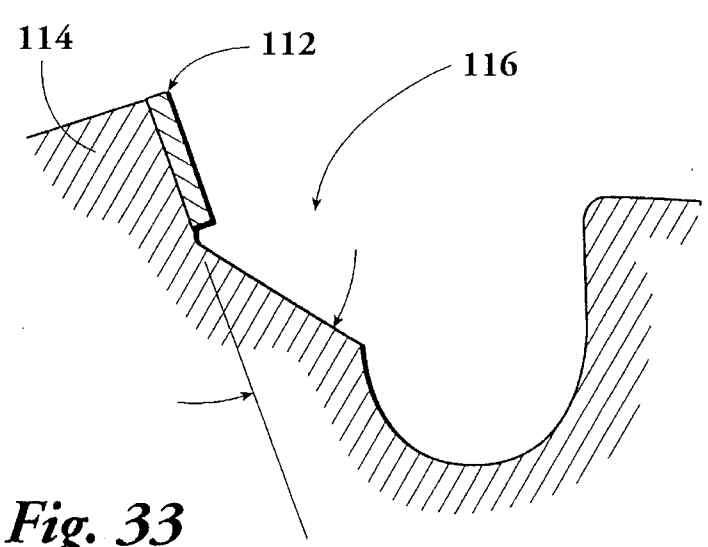
FIG. 33 is a partial sectional view of a cutter on a drill bit incorporating another embodiment of the present invention.

FIGS. 23–35 each depict a partial sectional view of a cutter on a drill bit incorporating a different embodiment of the present invention in which a cutter 112 is mounted on a drill bit body 114. A fluid course 116 is formed on body 114 to distribute drilling fluid across the face of the bit during drilling. In FIG. 35, a surface 119 is formed adjacent fluid course 116 as shown.

In operation, as a formation chip 118 (in FIGS. 25, 27, 29 and 34) is formed and moves down (with respect to the orientation of FIGS. 23–34) the face of cutter 112 and onto the surface of fluid course 116, the shape of the surface of the fluid course bends the chip thereby inducing stresses therein. As can be seen in the drawings, the free end of chip 118 is urged into the fluid course where fluid flow tends to break the chip away from the formation. Some of the embodiments have discontinuities formed in the fluid course, e.g., FIG. 25, whereby the free end of chip 118 is directed away from the wall of the fluid course and into a more central portion thereof where fluid flows at a faster rate and therefore exerts more force on the chip. In FIG. 35, a double strain is imparted to chip 118: first, when the chip bends responsive to sliding against the surface beneath cutter 112 and second, when the chip bends responsive to hitting surface 119.

It should be appreciated that structure for imparting a twist to the chip (as well as structure for relieving pressure between the chip and the bit body and cutter), as described in connection with previous embodiments herein, could be utilized in connection with the embodiments of FIGS. 23–35.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

We claim:

1. A drill bit for boring an earth formation and designed for rotation in a given direction, said drill bit comprising:

a bit body having an operating face;

a cutting element formed on said bit operating face;

a cutting surface formed on said cutting element and facing in a forward direction with respect to the direction of rotation;

a cutting edge formed on said cutting surface and being embedded in the earth formation during boring so that the formation is received against a portion of said cutting surface, said cutting element creating successive formation chips which grow in length during bit rotation;

a fluid course formed in front of said cutting element for directing a flow of fluid across said operating face during boring, wherein said fluid course is defined by a first wall positioned substantially adjacent said cutting element and a second wall spaced therefrom; and a discontinuity formed in said first wall, wherein said discontinuity is constructed and arranged to direct each of said chips into a central portion of said fluid course as the chip extends in length.

2. The drill bit of claim 1 wherein said fluid course includes a portion having a curved cross section and wherein said discontinuity comprises a substantially abrupt change in the curvature of the fluid course cross section.

3. The drill bit of claim 1 wherein said discontinuity is further constructed to cause twisting of each of said formation chips.

4. The drill bit of claim 1 wherein said drill bit further includes a plurality of cutting elements formed substantially in a row and wherein said discontinuity comprises a substantially continuous ridge formed on said operating face and extending along said row of cutting elements.

5. The drill bit of claim 1 wherein said drill bit further includes a plurality of cutting elements and wherein said discontinuity comprises a plurality of chip breakers formed on said operating face each being operatively associated with a different one of said cutting elements.

6. A method for drilling an earth formation using a drill bit of the type having a fluid course formed in front of a cutting element, said method comprising:

embedding an edge of the cutting element in an earth formation;

cutting a substantially planar formation chip with the cutting element edge responsive to drill bit rotation;

lengthening the formation chip and sliding it across a face of the cutting element responsive to further drill bit rotation;

urging a free end of the chip into the fluid course and away from the drill bit;

directing fluid along the fluid course and against the free end of the chip; and twisting that portion of the chip extending beyond the face of the cutting element substantially transversely to the flow of fluid in the fluid course.

7. A drill bit for boring an earth formation and designed for rotation in a given direction, said drill bit comprising:

a bit body having an operating face;

a cutting element formed on said bit operating face;

a cutting surface formed on said cutting element and facing in a forward direction with respect to the direction of rotation;

a fluid course formed in front of said cutting element for directing a flow of fluid across said operating face during boring;

a cutting edge formed on said cutting surface and being embedded in the earth formation during boring so that the formation is received against a portion of said cutting surface, said cutting element creating successive formation chips which grow in length during bit rotation; and a ramp for twisting each of said chips, said ramp disposed on said operating face between said cutting element and said fluid course.

8. A drill bit for boring an earth formation and designed for rotation in a given direction, said drill bit comprising:

a bit body having an operating face;

a cutting element formed on said bit operating face;

a cutting surface formed on said cutting element and facing in a forward direction with respect to the direction of rotation;

a fluid course formed in front of said cutting element for directing a flow of fluid across said operating face during boring;

a cutting edge formed on said cutting surface and being embedded in the earth formation during boring so that the formation is received against a portion of said cutting surface, said cutting element creating successive formation chips which grow in length during bit rotation; and a ramp for twisting each of said chips, said ramp disposed in said fluid course.

9. A drill bit for boring an earth formation and designed for rotation in a given direction, said drill bit comprising:

a bit body having an operating face;

a cutting element formed on said bit operating face;

a cutting surface formed on said cutting element and facing in a forward direction with respect to the direction of rotation;

a fluid course formed in front of said cutting element for directing a flow of fluid across said operating face during boring;

a cutting edge formed on said cutting surface and being embedded in the earth formation during boring so that the formation is received against a portion of said cutting surface, said cutting element creating successive formation chips which grow in length during bit rotation; and a ramp for twisting each of said chips, said ramp being constructed and arranged to twist each of said chips substantially transversely to fluid flowing across said operating face during boring.

10. The drill bit of claim 9, wherein said ramp is disposed in said fluid course.

11. A drill bit for boring an earth formation and designed for rotation in a given direction, said drill bit comprising:

a bit body having an operating face;

a cutting element formed on said bit operating face;

a cutting surface formed on said cutting element and facing in a forward direction with respect to the direction of rotation;

a fluid course formed in front of said cutting element for directing a flow of fluid across said operating face during boring;

a cutting edge formed on said cutting surface and being embedded in the earth formation during boring so that the formation is received against a portion of said cutting surface, said cutting element creating successive formation chips which grow in length during bit rotation, such chips including a first surface directed toward said cutting surface and an opposed second surface facing generally in the direction of bit rotation; and a surface disposed on said operating face between said cutting element and said fluid course for presenting one of said chip surfaces to the flow of fluid in said fluid course.

12. A drill bit for boring an earth formation and designed for rotation in a given direction, said drill bit comprising:

a bit body having an operating face;

a cutting element formed on said bit operating face;

a cutting surface formed on said cutting element and facing in a forward direction with respect to the direction of rotation;

a cutting edge formed on said cutting surface and being embedded in the earth formation during boring so that the formation is received against a portion of said cutting surface, said curling element creating successive formation chips which grow in length during bit rotation;

a fluid course formed in front of said cutting element for directing a flow of fluid across said operating face during boring; and a chip breaker disposed on said operating face between said cutting element and said fluid course if a position to be impacted by said chips as they grow in length, said chip breaker being mounted on said fluid course in a central portion thereof and further being constructed and arranged to bend said chips after each chip impacts the chip breaker and continues to grow in length.

13. The drill bit of claim 12 wherein said fluid course is defined by a first wall positioned substantially adjacent said cutting element, a second wall spaced therefrom and a floor disposed between the first and second walls and wherein said chip breaker is mounted on said floor.

14. The chip breaker of claim 12 wherein said chip breaker comprises a discontinuity formed in said fluid course.

15. The chip breaker of claim 14 wherein said discontinuity is constructed and arranged to direct each of said chips into a central portion of said fluid course as the chip extends in length.

16. The chip breaker of claim 14 wherein said fluid course includes a portion having a curved cross section and wherein said discontinuity comprises a substantially abrupt change in the curvature of the fluid course cross section.

17. The drill bit of claim 12 wherein said drill bit further includes a plurality of cutting elements formed substantially in a row and wherein said chip breaker comprises a substantially continuous ridge formed on said operating face and extending along said row of cutting elements.

18. The drill bit of claim 12 wherein said drill bit further includes a plurality of cutting elements and wherein said chip breaker comprises a plurality of chip breakers formed on said operating face each being operatively associated with a different one of said cutting elements.

* * * * *

UNITED STATES PATENT AND TRADEMARK OFFICE

CERTIFICATE OF CORRECTION

PATENT NO. : 5,582,258
DATED : Dec. 10, 1996
INVENTOR(S) : Tibbitts et al.

It is certified that error appears in the above-indentified patent and that said Letters Patent is hereby corrected as shown below:

Column 4, line 17, change "all" to --art--;

Column 6, line 34, change "ill" to --in--;
Column 6, line 35, change "ill" to --in--.

Signed and Sealed this

Eighth Day of September, 1998

*Attest:*

*Attesting Officer*

Bruce Lehman

BRUCE LEHMAN

*Commissioner of Patents and Trademarks*